United States Patent [19]

Kiss

[11] 4,065,635

[45] Dec. 27, 1977

[54] ELECTRICAL CABLES INSULATED WITH EXTRACTION RESISTANT STABILIZED MATERIAL

[75] Inventor: Kornel D. Kiss, Yonkers, N.Y.

[73] Assignee: Dart Industries, Inc., Los Angeles, Calif.

[21] Appl. No.: 641,313

[22] Filed: Dec. 16, 1975

Related U.S. Application Data

[63] Continuation of Ser. No. 390,834, Aug. 23, 1973, abandoned.

[51] Int. Cl.[2] ..... H01B 7/28

[52] U.S. Cl. ..... 174/23 R; 260/45.9 NC; 174/110 PM

[58] Field of Search ..... 260/45.9 NC; 174/23 C, 174/23 R, 25 R, 25 C, 110 PM, 137 B

[56] References Cited

U.S. PATENT DOCUMENTS

| | | | |
|---|---|---|---|
| 3,755,610 | 8/1973 | McTigue | 260/45.95 C |
| 3,772,245 | 11/1973 | Dexter | 260/45.9 NC |
| 3,773,722 | 11/1973 | Dexter | 260/45.9 NC |
| 3,793,473 | 2/1974 | Pointer | 260/45.75 |
| 3,887,518 | 6/1975 | Rosenberger et al. | 260/45.9 NC |

*Primary Examiner*—V. P. Hoke

*Attorney, Agent, or Firm*—Arthur S. Collins; Bryant W. Brennan; Fred S. Valles

[57] ABSTRACT

The insulation of electrical cables which are utilized in environments likely to cause extraction of stabilizer systems is achieved through the use of compositions in which a disubstituted alkylhydroxyphenyl alkanoyl hydrazine is used as extraction resistant stabilizer for ethylene-propylene copolymer coating materials. Equivalent nomenclature for the preferred stabilizer is disubstituted di-t-butyl hydroxy hydro cinnamoyl (DTBHC) hydrazine. The DTBHC hydrazine is substantially the only stabilizer used in the stabilized compositions.

3 Claims, No Drawings

ELECTRICAL CABLES INSULATED WITH EXTRACTION RESISTANT STABILIZED MATERIAL

This is a continuation of application Ser. No. 390,834, filed Aug. 23, 1973, now abandoned.

BACKGROUND OF THE INVENTION

1. Field of the Invention

This invention relates to polymeric compositions which are subject to degradation caused by exposure to heat and oxygen after extraction of stabilizers by such nongaseous fluids as organic fluids and aqueous fluids and various dispersions. More particularly, it relates to stabilized polypropylene compositions as insulation for underground electrical cables. The stabilizers used are certain disubstituted hydrazines.

2. Brief Description of the Prior Art

Electrical cables used in underground cable applications typically employ a plurality of individual plastic insulated wires encased in plastic tubing. Void spaces within the tubing are filled with a very high viscosity liquid such as petrolatum or petroleum jelly. A serious disadvantage to the use of plastic materials as insulators for this application has been the fact that the stabilizing amount of the antioxidants incorporated in the plastic insulation is extracted by the petrolatum. This causes a rapid deterioration of the insulaton due to the combined effects of heat and oxygen.

Prior art attempts to solve the extraction problem have led to a combination of particular hindered phenolic antioxidants which are not polymeric with certain poly (cyclo-hexylene-disulfides); see U.S. Pat. No. 3,392,141. However, the use of such a complex combination of compounds does not provide as efficient or an economical solution to the problem as does the use of the stabilizer of this invention, in which the extractibility problem is overcome.

Another serious disadvantage to the use of plastic materials, e.g., polypropylene, as insulation for wires and cables is the fact that the degradation of the polymer is accelerated by the presence of metals such as copper and alloys of copper. Prior art methods to solve this problem have resulted in a combination of polypropylene with a known antioxidant such as 4,4' thiobis (3-methyl-6-tertiary butyl phenol) and a copper deactivator such as oxalyl dihydrazide; see U.S. Pat. No. 3,484,285. However, these methods do not solve the problem when the resulting polymeric materials are contacted with petrolatum. In fact, results with similar combinations have indicated that the deactivation due to copper accelerated even further after the polymeric material has been subjected to extraction with petrolatum.

It is well known to stabilize plastics against degradation due to heat and oxidation by incorporating into the polymers a stabilizing amount of certain hindered phenolic antioxidants such as tetra-[methylene 3-(3,5-di-t-butyl-4-hydroxyphenyl) propionate] methane as disclosed in U.S. Pat. No. 3,285,855. However, such antioxidant stabilizers have not proved entirely satisfactory for many end uses. This is true because of the relative ease with which they can be extracted from the polymers by nongaseous fluids. An example of such an extraction, is seen in the extraction of stabilizers from the polymer material used as plastic insulation for wires in underground cables.

U.S. Pat. No. 3,660,438 discloses materials which are useful as stabilizers of organic materials which are subject to oxidative deterioration. Organic materials include: synthetic organic polymeric materials such as vinyl resins formed from the polymerizaton of vinyl halides or from the copolymerization of vinyl halides with unsaturated polymerizable materials, e.g. vinyl esters, unsaturated aldehydes and unsaturated hydrocarbons such as butadienes and styrene; polyolefins such as polyethylene, polypropylene, polybutylene, polyisoprene, and the like, including copolymers of olefins, polyurethane and polyamides such as polyhexamethylene adipamide and polycaprolactam; polyesters such as polyethylene terephtahalates; polycarbonates; polyacetals; polystyrene; polyethyleneoxide; and copolymers such as those of high impact polystyrene containing copolymers of butadiene and styrene and those formed by the copolymerization of acrylonitrile, butadiene and/or styrene. Other materials which can be stabilized by the active compounds of the invention of the patent, include lubricating oil of the aliphatic ester type, pentaerythritol tetra-caproate, and the like; animal and vegetable derived oils, such as linseed oil, fat, tallow, lard, peanut oil, cod liver oil, etc. and hydrocarbon materials such as gasoline, mineral oil, fuel oil, drying oil, cutting fluid, waxes, resins and the like; fatty acids such as soaps and the like.

The patent discloses that the particularly advantageous range of the present stabilizers for polyolefins such as polypropylene is from about 0.05% to about 2% and that in general one or more of the stabilizers are employed in amounts, in toto of from about 0.005 to about 5% by weight of the composition containing the organic material. The stabilizers employed can also be used in combination with other stabilizers or additives, and include especially useful costabilizers such as di-lauryl-beta-thiodi-propionate and di-stearyl-beta-thiodipropionate. Further disclosed that other antioxidants, antiozonants, thermal stabilizers, ultraviolet light absorbers, coloring materials, dyes, pigments, metal chelating agents, etc. may be used in the compositions of the patent.

It is disclosed, however, that in accordance with Example XI when 1.5% of copper dust was attempted to be milled into the unstabilized resin, deterioration occurred and further milling was prevented.

In the U.S. Pat. No. 3,660,438 patent, it is shown an Example IX-A, Table I, that the combination of a propionyl-hydrazide or a propionyl-hydrazine and distearylthiodipropionate (DSTDP) produced roughly two to three times the stabilization of polypropylene as the propionyl-hydrazide and the propionyl-hydrazine used alone, and the improvement appears to result from the use of high quantities of DSTDP.

In Example X it is shown that the propionyl-hydrazide stabilizer noted in Example IX-A, when used alone in contact with copper dust, give roughly one fourth of the period of stabilization obtained in the absence of copper dust, and less than one tenth of the period of stabilization obtained with the propionyl-hydrazide — DSTDP combination.

Using what appears to be the most effective material of the U.S. Pat. No. 3,660,438 patent, specifically the propionyl-hydrazine and DSTDP combination of Example IX-A, a test was run to evaluate the ability of the stabilizer system to be used in wire coating applications.

Using an ethylene-propylene copolymer wire coating applicability test procedure it was found that the DTA value in a differential scanning calorimeter was 4 minutes non-extracted and 3 minutes extracted. (See Run 2 of Table I.) Increasing the propionyl-hydrazine concentration to 0.3, while maintaining the concentration of the system at 0.6, improved the results. A DTA (non-extracted) value of 25 min. was obtained and after extraction, the value was essentially unchanged. (See Run 2 of Table I.) The use of 0.3% of the propionyl-hydrazine in combination with 0.3% of either, a poly (1.4 cyclohexylene dimethylene-3,3' thio-dipropionate) sold under the Trade Mark Tenamene 2000, by Eastman Chemical Products, Inc., Kingsport, Tennessee; or a tetra [(methylene 3-) 3,5-di-t-butyl-4-hydroxyphenyl) propionate] methane sold under the Trade Mark Irganox 1010, by Ciba-Geigy Corporation, Ardsley, N. Y.; or a N,N''' diacetyl, N', N'' adipoyl dihydrazide sold under the Trade Mark G109367R by Ciba-Geigy Corporation gave essentially the same results after extraction. (15–20 minutes). The non-extracted value for the Irganox1010 combination, however, was 60 minutes. (See Run 10 of Table I.)

The use of 0.1% of the hydrazine by itself gave better results than the 0.1% hydrazine plus 0.5% Tenamene 2000, but still gave an unacceptable value of 4 minutes after extraction, although the non-extracted value was 20 minutes. (See Run 2 of Table II.)

The U.S. Pat. No. 3,660,438 patent thus appears to disclose a combination which would not lend the requisite stabilization to an ethylene-propylene copolymer wire coating composition and from the aforenoted tests would not appear to be sufficiently resistant to extraction, to be used in petrolatum contacting wire cable coatings.

It is noted that the high cost of available materials, such as the N,N'-bis$\beta$- -(3,5-di-t-butyl-4-hydroxyphenyl)-propionyl-hydrazine, sold under the Trade Mark CHA-1024 by Ciba-Geigy, the use of 2% or 10% of the stabilizer in a coating composition as indicated in Example X11, would be uneconomical for underground wire cable systems. Thus, from evidence heretofore noted, it would appear that the use of hydrazines and hydrazides as disclosed in the aforenoted U.S. Pat. No. 3,660,438 patent would be either commercially uneconomical or functionally insufficient, or both, with regard to stabilization of polypropylene wire coatings installed in underground cables.

TABLE I

| | | STABILIZER COMPONENTS | | | | DTA, Stability, min. | | |
|---|---|---|---|---|---|---|---|---|
| | | ppm | | DTBHC | Di (DTBHC) | No Extraction | | Extraction |
| | Polymer | Component | ppm | hydrazide | hydrazine | on Al | on Cu | on Cu |
| Run: | | | | | | | | |
| 1. | Polypropylene | DSTDP | 5,000 | 1,000 | | 1 | 1 | 1 |
| 2. | " | DSTDP | 5,000 | | 1,000 | 4 | 4 | 3 |
| 3. | " | DSTDP | 3,000 | 3,000 | | 9 | 1 | 1 |
| 4. | " | DSTDP | 3,000 | | 3,000 | 58 | 25 | 24 |
| 5. | " | Tenamene 2000 | 5,000 | 1,000 | | 1 | 1 | 1 |
| 6. | " | Tenamene 2000 | 5,000 | | 1,000 | 4 | 2 | 2 |
| 7. | " | Tenamene 2000 | 3,000 | 3,000 | | 11 | 2 | 2 |
| 8. | " | Tenamene 2000 | 3,000 | | 3,000 | 40 | 12 | 15 |
| 9. | " | Irganox 1010 | 3,000 | 3,000 | | 38 | 5 | 5 |
| 10. | " | Irganox 1010 | 3,000 | | 3,000 | 64 | 60 | 15 |
| 11. | " | Gl 09 367R | 3,000 | 3,000 | | 11 | 5 | 3 |
| 12. | " | Gl 09 367R | 3,000 | | 3,000 | 27 | 23 | 20 |
| 13. | Polystyrene | | | | | | 1 | 1 |
| 14. | " | | 5,000 | | | 2 | 2 | |
| 15. | " | | | | 5,000 | | 3 | 3 |
| 16. | LDPE | | | | | | 2 | 1 |
| 17. | " | | | | 1,000 | | 25 | 1 |
| 18. | " | | | | 2,000 | | 55 | 9 |
| 19. | HDPE | | | | | | 4 | 1 |
| 20. | " | | | | 1,000 | | 34 | 10 |
| 21. | " | | | | 2,000 | | 58 | 10 |

TABLE II

| | STABILIZER COMPONENTS, ppm | | DTA, Stability, min. | | | LTHA, Stability, hrs | |
|---|---|---|---|---|---|---|---|
| | DTBHC | Di (DTBHC) | No Extraction | | Extraction | | |
| Polymer | hydrazide | hydrazine | on Al | on Cu | on Cu | No Extraction | Extraction |
| Run: | | | | | | | |
| 1. Polypropylene (Copolymer) | 1,000 | | 1 | 1 | 1 | | |
| 2. Polypropylene (Copolymer) | | 1,000 | 14 | 20 | 4 | | |
| 3. Polypropylene (Copolymer) | | 2,500 | 35 | 23 | 13 | 310 | 280 |
| 4. Polypropylene (Copolymer) | 3,000 | | 9 | 1 | 1 | | |
| 5. Polypropylene (Copolymer) | | 3,000 | 41 | 37 | 21 | | |
| 6. Polypropylene (Copolymer) | | 5,000 | 78 | 56 | 44 | 585 | 400 |
| 7. Polypropylene (Copolymer) | 5,000 | | 10 | 3 | 1 | | |
| 8. Polypropylene (Copolymer) | 6,000 | | 14 | 4 | 1 | | |
| 9. Polypropylene (Copolymer) | | 6,000 | 82 | 62 | 46 | | |
| 10. Polypropylene (Copolymer) | | 7,500 | 113 | 74 | 80 | 775 | 690 |
| 11. Polypropylene (Copolymer) | | 10,000 | 139 | 89 | 82 | 970 | 930 |
| 12. Polypropylene (Copolymer) | | 10,000 | 133 | 103 | 107 | | |

TABLE II-continued

| Polymer | STABILIZER COMPONENTS, ppm DTBHC hydrazide | Di (DTBHC) hydrazine | DTA, Stability, min. No Extraction on Al | No Extraction on Cu | Extraction on Cu | LTHA, Stability, hrs No Extraction | Extraction |
|---|---|---|---|---|---|---|---|
| 13. Polypropylene (Copolymer) | | 20,000 | 260 | 177 | 163 | 1,200 | |

The polypropylene of the Tables is a polypropylene copolymer containing about 12 weight percent ethylene, having a density of about 0.9, a melt index at 230° C of about 3 gms./10 min. and containing about 96 percent heptane insolubles. The polypropylene was blended with the amount of the constituents indicated in the tables until a homogenous composition was obtained. Each of the blended samples was then compression molded into 6 inches × 6 inches × 10 mil plaques at 400° F and 25,000 psig for 60 seconds. The plaques were rapidly cooled at high pressure an cut into 1½ inch × 1½ inch × 10 mil strips.

The extraction procedure involved submerging strips in U.S.P. Grade petrolatum at 86° ± 1° C for 8 hours. The strips were removed from the petrolatum, wiped clean and then aged by being maintained in an air circulating oven for 18 hours at 86° C.

Differential thermal analysis (DTA) provides an extremely effective method for obtaining accelerated aging data which can be extrapolated to periods of decades at ambient temperatures.

The controls and examples were all tested by the following DTA procedures: A small sample of the 10 mil. film strip prepared in the compression mold, having a diameter of approximately 0.25 inches is placed on a copper test pan in a Perkin-Elmer differential scanning calorimeter (DSC). The pan is then covered and heated from room temperature at a linear programmed rate of 10° C/min in the presence of nitrogen flowing through the DSC at a rate of 0.08 cu. ft. per hour. When the temperature in the DSC reaches 200° C, the nitrogen is automatically stopped and oxygen flowing at the same rate is passed through the DSC. The temperature is maintained at 200° C until the oxidation peak has occurred and the induction period is measured in minutes from the time the oxygen is added until the oxidative degradation occurs. For aluminum test an aluminum test pan is used in place of the copper test pan.

Long term aging (LTHA) tests involved placing five specimens of a sample to be tested on copper sheets and subjecting the specimens to a temperature of 150° C in a Model 625A Freas forced draft oven. The specimens are checked periodically for signs of failure. The time to failure (visible degradation) for each of the five specimens is averaged to obtain the oven life results, (LTHA).

LTHA tests on samples subjected to extraction involved first subjectng the sample to extraction as previously noted and then to the LTHA test and similarly. DTA-extraction tests were run on samples which had been subjected to the extraction procedure.

When the terms hydrazine and hydrazides are used herein, it is intended merely as a short hand reference to the alkyl hydroxyphenyl alkanoyl-hydrazines of the invention and the corresponding hydrozides.

The polystyrene of Table I is high impact, extrusion grade, unstabilized polymer having a melt flow of 1.4 grams/10 min., an Izod impact of 1.6 ft. lbs./in. notch, and sold under the Trade Mark Rexene 410S, by the Rexene Polymers Company.

The low density polyethylene (LDPE) is an unstabilized, 0.3 melt flow, 0.923 density polymer, sold under the Trade Mark Rexene X0544, by the Rexene Polymers Company.

The high density polyethylene (HDPE) is a 0.15 MPR, 0.948 density, unstabilized, extrusion grade polymer, sold under the Trade Mark, Chemplex 5601 by the Chemplex Company.

The hydrazines of the present invention can be represented by the following formula:

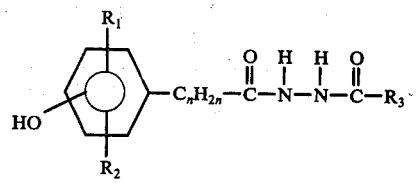

wherein $R_1$ is a lower alkyl group containing from 1 to 6 carbon atoms or hydrogen;

$R_2$ is a lower alkyl group containing from 1 to 6 carbon atoms or hydrogen, but wherein $R_1$ and $R_2$ are not both hydrogen;

$R_3$ is an alkyl, aryl or an aralkyl group containing from 1 to 18 carbon atoms; and $n$ is a number from 0 to 5.

Illustrative examples of lower alkyl groups are methyl, ethyl, propyl, isopropyl, butyl, t-butyl, pentyl, hexyl and the like. The preferred groups are the tertiary alkyls.

Illustrative examples of the $R_3$ group includes the lower alkyl groups as well as higher alkyl groups such as heptyl, octyl, decyl, dodecyl, tetradecyl, hexadecyl, octadecyl and the like, both straight chain and branched chain. Other illustrative examples of the $R_3$ group include lauryl, stearyl, phenyl and benzyl.

The use of 1000 ppm of the stearyl derivative of the above formula, specifically, in which $R_1$ and $R_2$ are tertiary butyl groups, $n$ is 2, and $R_3$ is a stearyl group, in place of the hydrazine of Run 2 of Table II, gave a DTA without extraction in contact with aluminum, of 70 minutes, and in contact with copper, of 62 minutes, and with extraction, in contact with copper of 52 minutes, thus showing a high extraction resistance.

In place of the stearyl group of the above compound, an acetyl group was used, and 5000 ppm of the compound was used in place of the hydrazine of Run 6 of Table II. The DTA, in contact with aluminum was 13 minutes and in contact with copper was 12 minutes. The DTA test after extraction (in contact with copper) gave a result of 14 minutes, showing an excellent extraction resistance.

It should be noted, that results of 12, 13 and 14 minutes are considered essentially equivalent and within the range of experimental error. Thus, the 14 minute result with extraction, is not to be considered to be better than the 12 minute non-extraction test.

It is evident from the foregoing examples and runs 3, 5, 6 and 9 to 13, of Table II, that the disubstituted hydrazines when used alone in concentrations of at least 2500 ppm, produce excellent stabilization of ethylene-propylene copolymers and unexpected extraction resistance and results in a commercially feasible system for use in underground cables.

The compatibility between ethylene groups of the copolymer wire coating material and the high viscosity fluid such as a polyethylene wax or petrolatum produces an excessive tendency for the stabilizer component to be extracted from the wire coating system by the fluid. It is not clearly understood why the di substituted di alkyl hydroxy hydro cinnamoyl hydrazines of the instant invention exhibit such a high extraction resistance in the wire coating systems.

It should be understood that while, for convenience, discussions and tests have been limited primarily to petrolatum as the fluid in the coated wire electrical cables, other materials, particularly petroleum products can be used. Low molecular weight polyethylene waxes are illustrative of useful fluids.

It should be understood that my single component stabilizer, wire coating system can contain commonly employed additives other than stabilizers such as colorants, antistatic agents, rodent repellents and the like.

What is claimed is:

1. In an outer-jacketed electrical cable suitable for use in underground installations and comprising a plurality of metal wires individually encased in an insulating covering having an ethylene-propylene copolymer resin base containing a minor addition of protective stabilizer with said insulating covering being immersed in a high viscosity liquid filler compound based upon petroleum fractions or polyethylene wax, the improvement wherein said protective stabilizer consists essentially of between about 2500 and about 20,000 parts of disubstituted hydrazine chosen from N,N$^1$-bis-$\beta$-(3,5-di-t-butyl-4-hydroxyphenyl) propionyl-hydrazine and N-stearoyl, N$^1$-$\beta$-(3,5-di-t-butyl-4-hydroxyphenyl) propionyl-hydrazine per million parts by weight of said ethylene-propylene copolymer.

2. The electrical cable of claim 1 wherein said stabilizer consists essentially of N,N$^1$-bis-$\beta$-(3,5-di-t-butyl-4-hydroxyphenyl) propionyl-hydrazine.

3. The electrical cable of claim 1 wherein said stabilizer consists essentially of N-stearoyl, N$^1$-$\beta$-(3,5-di-t-butyl-4-hydroxyphenyl) propionyl-hydrazine.

* * * * *

UNITED STATES PATENT AND TRADEMARK OFFICE

CERTIFICATE OF CORRECTION

PATENT NO. : 4,065,635

DATED : December 27, 1977

INVENTOR(S) : Kornel D. Kiss

It is certified that error appears in the above-identified patent and that said Letters Patent are hereby corrected as shown below:

Column 1, line 29, change "insulaton" to --insulation--

Column 3, line 8, change "Run 2" to --Run 4--

Column 3, line 9, change "1.4" to --1,4--

In line 1 of Table I, after "Components" insert --ppm--

In the line of Table I which represents the data for Run 14, delete "5000" appearing under column headed "ppm" and insert--5000-- under column headed" DTBHC Hydrazide."

In the line of Table I which represents the data for Run 14, delete "2" appearing under column headed "No Extraction on Al" and insert --2-- under column headed "Extraction on Cu".

UNITED STATES PATENT AND TRADEMARK OFFICE

CERTIFICATE OF CORRECTION

PATENT NO. : 4,065,635 Page 2 of 2

DATED : December 27, 1977

INVENTOR(S) : Kornel D. Kiss

It is certified that error appears in the above-identified patent and that said Letters Patent are hereby corrected as shown below:

Column 5, line 58, change "subjectng" to --subjecting--

Column 5, line 65, change "hydrozides" to --hydrazides--

Column 6, line 17, change "MPR" to --MFR--

Signed and Sealed this

*Sixth* Day of *June 1978*

[SEAL]

*Attest:*

RUTH C. MASON
*Attesting Officer*

DONALD W. BANNER
*Commissioner of Patents and Trademarks*